US007809291B2

(12) United States Patent
Takeuchi et al.

(10) Patent No.: US 7,809,291 B2
(45) Date of Patent: Oct. 5, 2010

(54) IMAGE FORMING APPARATUS WITH A TWO COMPONENT DEVELOPER, TONER DENSITY DETECTION AND TONER DENSITY CORRECTION

(75) Inventors: Nobutaka Takeuchi, Yokohama (JP); Shinji Kato, Kawasaki (JP); Shin Hasegawa, Zama (JP); Kouta Fujimori, Yokohama (JP); Kayoko Tanaka, Edogawa (JP); Yushi Hirayama, Sagamihara (JP); Takashi Enami, Chigasaki (JP); Kazumi Kobayashi, Setagaya-ku (JP); Kiichiro Shimizu, Fujisawa (JP)

(73) Assignee: Ricoh Company, Ltd., Tokyo (JP)

( * ) Notice: Subject to any disclaimer, the term of this patent is extended or adjusted under 35 U.S.C. 154(b) by 470 days.

(21) Appl. No.: 11/558,674

(22) Filed: Nov. 10, 2006

(65) Prior Publication Data

US 2007/0116480 A1 May 24, 2007

(30) Foreign Application Priority Data

Nov. 11, 2005 (JP) ..... 2005-327647

(51) Int. Cl.
*G03G 15/08* (2006.01)

(52) U.S. Cl. ..... 399/27

(58) Field of Classification Search ..... 399/27, 399/49, 59

See application file for complete search history.

(56) References Cited

U.S. PATENT DOCUMENTS 5,327,196 A 7/1994 Kato et al.
5,493,382 A 2/1996 Takagaki et al.

(Continued)

FOREIGN PATENT DOCUMENTS

EP 0 487 009 A2 5/1992

(Continued)

OTHER PUBLICATIONS

U.S. Appl. No. 11/932,198, filed Oct. 31, 2007, Takeuchi, et al.

(Continued)

*Primary Examiner*—Quana M Grainger
(74) *Attorney, Agent, or Firm*—Oblon, Spivak, McClelland, Maier & Neustadt, L.L.P.

(57) ABSTRACT

An image forming apparatus in which a predetermined image density can be obtained by correcting a toner density control target value without consuming toner. The output value Vt of the magnetic permeability sensor and the target output value $Vt_{ref}$ are compared, and the toner density is controlled by controlling a powder pump on the basis of the comparative result thereof so that the output value Vt approximates the target output value $Vt_{ref}$. In addition, the target output value $Vt_{ref}$ is corrected on the basis of the detected result of the image coverage ratio so as to maintain a predetermined development potential of the development apparatus. By virtue of this, even when image forming that involves a significant change in the toner replacement amount in the development apparatus is performed, for example, even when an image of high image coverage ratio is output, the toner density is adjusted to maintain the development capability at a constant, and a predetermined image density is ensured. Moreover, because the image coverage ratio can be detected without consuming toner, toner does not need to be consumed when the target output value $Vt_{ref}$ is corrected.

14 Claims, 8 Drawing Sheets

U.S. PATENT DOCUMENTS

| | | | | |
|---|---|---|---|---|
| 5,604,575 | A | 2/1997 | Takagaki et al. | |
| 5,737,680 | A | 4/1998 | Takagaki et al. | |
| 6,404,997 | B1 | 6/2002 | Grace | |
| 7,515,844 | B2 * | 4/2009 | Tanaka et al. | 399/59 |
| 7,536,121 | B2 * | 5/2009 | Shimizu et al. | 399/27 |

FOREIGN PATENT DOCUMENTS

| | | |
|---|---|---|
| JP | 57-136667 | 8/1982 |
| JP | 2-34877 | 2/1990 |
| JP | 7-234582 | 9/1995 |
| JP | 10-282740 | 10/1998 |

OTHER PUBLICATIONS

U.S. Appl. No. 12/037,717, filed Feb. 26, 2008, Takeuchi, et al.
U.S. Appl. No. 07/811,056, filed Dec. 20, 1991, Kouji Ishigaki, et al.
U.S. Appl. No. 11/856,304, filed Sep. 17, 2007, Oshige, et al.
U.S. Appl. No. 12/093,753, filed May 15, 2008, Oshige et al.
U.S. Appl. No. 12/094,198, May 19, 2008, Kato et al.

* cited by examiner

FIG. 8

| MOVING AVERAGE VALUE OF IMAGE COVERAGE RATIO [%] | ΔTC [wt%] | ΔVtref [V] |
|---|---|---|
| M(i)<1 | 0.5 | −0.15 |
| 1≦M(i)<2 | 0.4 | −0.12 |
| 2≦M(i)<3 | 0.3 | −0.09 |
| 3≦M(i)<4 | 0.2 | −0.06 |
| 4≦M(i)<6 | 0.0 | 0.00 |
| 6≦M(i)<7 | −0.1 | 0.03 |
| 7≦M(i)<8 | −0.2 | 0.06 |
| 8≦M(i)<9 | −0.3 | 0.09 |
| 9≦M(i)<10 | −0.4 | 0.12 |
| 10≦M(i)<20 | −0.5 | 0.15 |
| 20≦M(i)<30 | −0.6 | 0.18 |
| 30≦M(i)<40 | −0.7 | 0.21 |
| 40≦M(i)<50 | −0.8 | 0.24 |
| 50≦M(i)<60 | −0.9 | 0.27 |
| 60≦M(i)<70 | −1.0 | 0.30 |
| 70≦M(i)<80 | −1.0 | 0.30 |
| 80≦M(i) | −1.0 | 0.30 |

IMAGE FORMING APPARATUS WITH A TWO COMPONENT DEVELOPER, TONER DENSITY DETECTION AND TONER DENSITY CORRECTION

BACKGROUND OF THE INVENTION

1. Field of the Invention

The present invention relates to an image forming apparatus such as a copier, a printer and a facsimile device, and more particularly relates to an image forming apparatus that performs image formation employing a two-component developer comprising a toner and a magnetic carrier.

2. Description of the Related Art

Two-component development systems in which a two-component developer (hereinafter referred to simply as "developer") comprising a toner and a magnetic carrier is carried on a developer carrier and in which development is carried out as a result of a magnetic brush being formed from the developer by magnetic poles provided within the developer carrier and a latent image on a latent image carrier being rubbed by the magnetic brush are widely known in the prior art. Two-component development systems are being widely utilized because of the simplicity of coloring they afford. When the toner density as an expression of the ratio (for example, weight ratio) of the toner and magnetic carrier in a developer in a two-component developer system is too high, blemishes and a depot in the fine resolution of the formed image occur. On the other hand, when the toner density lowers, the density of the solid image portion drops and adhesion of the carrier to the latent image carrier occurs. Accordingly, it is essential that a toner density control involving the control of a toner supply operation based on the detection of the toner density in the developer of the development apparatus to be performed to always maintain the toner density in the developer within the appropriate range.

In addition, it is essential that the image forming performed by the image forming apparatus be performed in a way that in general always produces a constant image density. Image density is principally determined by the development capability of the development apparatus. Development capability, which refers to a capability that expresses the extent to which toner can be adhered to a latent image during development, changes in accordance with, in addition to toner density, development conditions such as development potential or the toner charge amount contributing to development. A gradient (development $\gamma$) of a relational expression that describes the toner adhered amount with respect to the development potential is widely used as an index for denoting development capability. Because the image density is determined by the development capability of the development apparatus in this way, performing the toner density control alone described above to produce a toner density that is always within the appropriate range cannot produce a constant image density. In addition, even though it is comparatively easy to ensure development conditions such as the development potential are made constant, ensuring the toner charge amount contributing to development is made constant is difficult. Accordingly, there is a drawback inherent thereto in that, even if the development conditions are made constant and, in addition, a toner density control is performed to ensure the toner density is made constant, unless the development capability can be made constant a constant image density cannot be produced.

More specifically, for example when an image of low image coverage ratio is output, because the amount of toner used to develop this image is comparatively small, a small amount of toner is supplied to maintain the prescribed toner density. Accordingly, a large amount of toner is present in the development apparatus for a comparatively long time. Because the toner present in the development apparatus for a comparatively long time is subjected to an agitating action for a long time, most of the toner contributing to development is sufficiently charged to the desired charge amount. Accordingly, this gives rise to a comparatively low development capability. In contrast, when an image of high image coverage ratio is output, a large amount of just supplied new toner that has not been sufficiently charged is present (in the development apparatus), and a large ratio of the toner contributing to development is occupied by toner that has not been sufficiently charged to the prescribed charge amount. As a result, a comparatively high development capability is created. More particularly, to meet the demand for the compacting of development apparatuses that has occurred in recent years, the trend is towards as far as possible minimizing the amount of developer that is held in the development apparatus. Accordingly, for image formation performed following the output of an image of high image coverage ratio, the ratio of toner contributing to development that has not been sufficiently charged to the desired charge amount is greater. Accordingly, a comparative increase in the development capability during the image formation that follows the output of an image of high image coverage ratio is liable to be created.

In addition, based on this configuration, it is possible for the development capability when an image of low image coverage ratio is output to be higher than that when an image of high image coverage ratio is output. For example, employing a toner to which an external additive has been adhered and employing a development apparatus in which this toner creates a high stress, as a result of the toner present for a comparatively long time in the development apparatus being subjected to an agitation action for a long period, the external additive becomes either embedded in the toner surface or separates from the toner surface. Where this happens to a lot of the toner, a worsening of the fluidity of the developer occurs, the charge capability of the toner itself drops, and the toner contributing to development cannot be sufficiently charged to the desired charge amount. Accordingly, when an image of low image coverage ratio is output, because of the increase in the ratio of toner contributing to development that is not sufficiently charged to the desired charge amount, a comparatively large development capability is created. In contrast, because of the large amount of supplied toner when an image of high image coverage ratio is output, the amount of toner present for a comparatively long time in the development apparatus is small. Accordingly, the developer has good fluidity and, in addition, most of the toner has a sufficiently high charge capability. Accordingly, because the toner contributing to development can be sufficiently charged to the desired charge amount, a comparatively low development capability is created.

As is described above, differences in development capability between when an image of low image coverage ratio is output and an image of high area ratio is output are produced because of the difference in the ratio of the toner present in the development apparatus caused by the subsequent toner supply. Accordingly, there is a drawback inherent thereto in that, even if the development conditions are made constant and, in addition, a toner density control is performed to ensure the toner density is made constant, unless the development capability can be made constant a constant image density cannot be produced.

Examples of image forming apparatuses able to suppress this drawback include the apparatuses described in Japanese Unexamined Patent Application No. S57-136667 and Japanese Unexamined Patent Application No. H2-34877. In these image forming apparatuses, which comprise toner density detection means for detecting and outputting the toner density of a two-component developer of a development apparatus, a control that involves a comparison of the output value of toner density detection means and a toner density control standard value and the control of toner supply device based on the comparative result thereof so that the toner density of the developer within the development apparatus is produced in the desired toner density is performed. In addition, the density of a standard toner pattern formed in a non-imaging part is detected and, as a result, the image density during the forming of the standard pattern is ascertained and, based on the detected result thereof, a toner density control target value is corrected. Based on this method, image formation at the desired image density can be performed for a short time period following this correction. Accordingly, forming a standard toner pattern and regularly correcting the toner density control target value in response to the detected result thereof can produce a constant image density.

However, in the image forming apparatuses described in these applications, standard toner patterns must be formed to the extent that the toner density control target value is corrected. Accordingly, and inherent problem thereof is the increased use of the amount of toner not employed in the image formation.

SUMMARY OF THE INVENTION

With the foregoing in view, it is an object of the present invention to provide an image forming apparatus able to produce a constant image density by correcting a toner density control target value without consuming toner.

In accordance with the present invention, an image forming apparatus comprises a latent image carrier; a development apparatus in which a two-component developer containing a toner and a magnetic carrier is carried on a developer carrier and which performs development in which, by bringing the two-component developer on the developer carrier into contact with the surface of the latent image carrier, the toner is adhered to the latent image on the surface of the latent image carrier; a toner supply apparatus for supplying the toner to the development apparatus; a toner density detection device for detecting and outputting toner density of the two-component developer in the development apparatus; a toner density control device for comparing an output value of the toner density detection device and toner density control standard value and, by controlling the toner supply apparatus on the basis of the comparative result, controlling the toner density so that the output value approximates the toner density control standard value; an information detection device for detecting information for ascertaining a toner replacement amount in the development apparatus in a prescribed time period; and a correction device for correcting the toner density control standard value on the basis of the detected result by the information detection device so as to maintain a predetermined development capability of the development apparatus.

BRIEF DESCRIPTION OF THE DRAWINGS

The above and other objects, features and advances of the present invention will become more apparent from the following detailed description based on the accompanying drawings in which:

FIG. 8 is a diagram showing an example of an LUT in which the sensitivity of the magnetic permeability sensor is 0.3;

DESCRIPTION OF THE PREFERRED EMBODIMENTS

A first embodiment of the present invention having application in an electrophotographic-type color laser printer (hereinafter referred to as a "laser printer") serving as an image forming apparatus will be hereinafter described.

Figure 1:
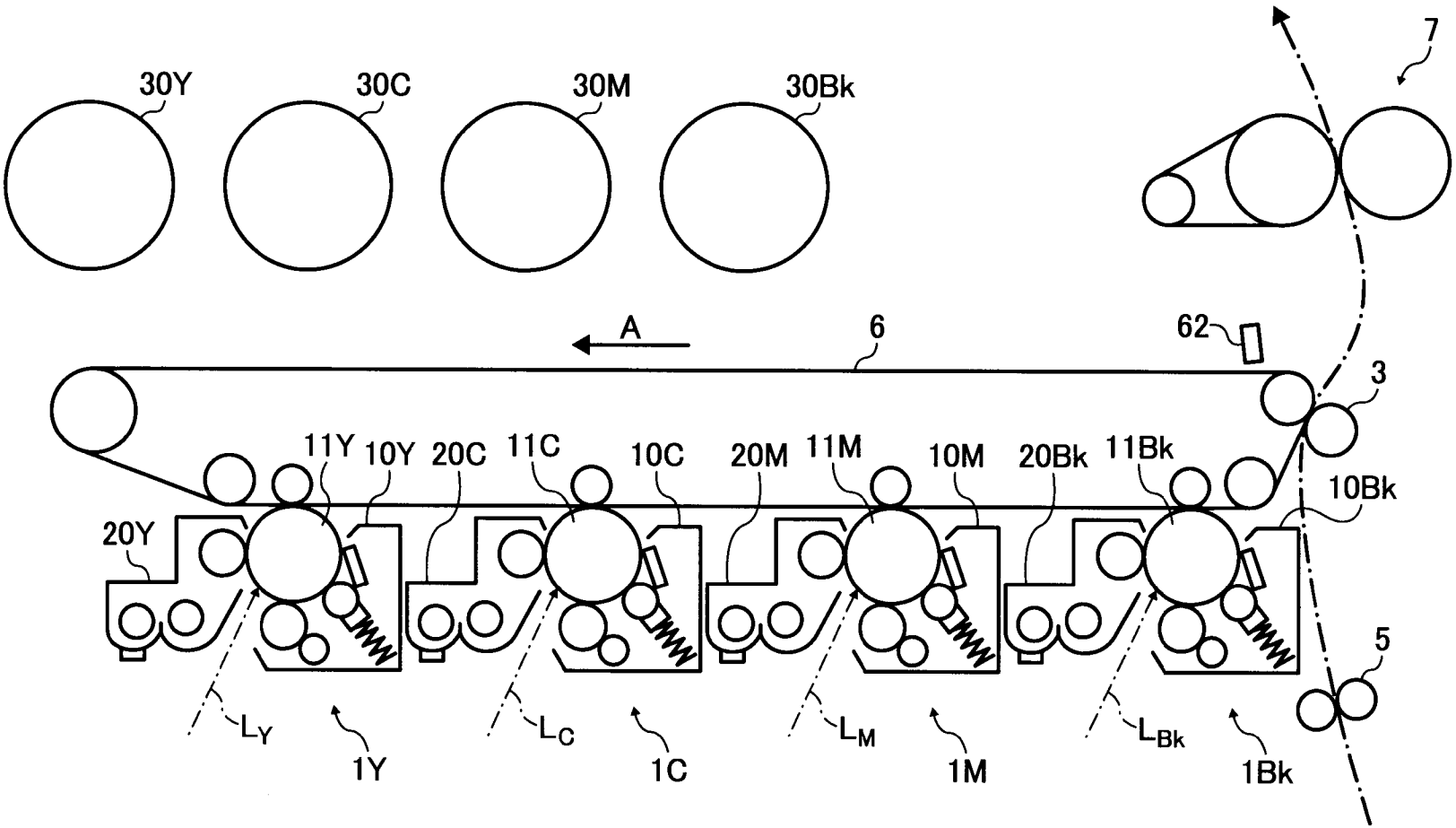
FIG. 1 is a schematic configuration diagram of the main part of a laser printer of a first embodiment of the present invention.

FIG. 1 shows the schematic configuration of the main part of a laser printer pertaining to the present embodiment. The laser printer comprises four sets of imaging means 1Y, 1C, 1M, 1BK (hereinafter the annotated symbols Y, C, M, BK are used to denote yellow, cyan, magenta and black members respectively) for forming images of the colors magenta (M), cyan (C), yellow (Y) and black (BK) arranged in order from the upstream side in the direction of movement of the surface of an intermediate transfer belt 6 serving as an intermediate transfer member (direction of the arrow A in the drawing). The imaging means 1Y, 1C, 1M, 1BK each comprise photoreceptor units 10Y, 10C, 10M, 10BK having drum-like photoreceptors 11Y, 11C, 11M, 11BK serving as latent image carriers, and development apparatus 20Y, 20C, 20M, 20BK. In addition, the arrangement of the imaging means 1Y, 1C, 1M, 1BK is established so that the rotational axes of the photoreceptors 11Y, 11C, 11M, 11BK of the photoreceptor units are parallel and orientated in a prescribed pitch in the direction of movement of the surface of the intermediate transfer belt 6.

The toner images on the photoreceptors 11Y, 11C, 11M, 11BK formed by imaging means 1Y, 1C, 1M, 1BK are sequentially overlapped and primary transferred onto the intermediate transfer belt 6. Accompanying the movement of the surface of the intermediate transfer belt 6, these color images obtained by superposing are carried to a secondary transfer unit between secondary transfer rollers 3. In this laser printer, in addition to imaging means 1Y, 1C, 1M, 1BK, an optical writer unit not shown in the diagram is arranged therebelow, and a paper supply cassette not shown in the diagram is arranged further therebelow. The single dotted line in the diagram indicates the carry path of the transfer paper. The transfer paper serving as the transfer material (recording medium) which is supplied from the paper cassette is carried by carry rollers while being guided by a carry guide not shown in the diagram and forwarded to a temporary stop position in which resist rollers 5 are provided. The transfer paper is supplied to the secondary transfer unit at a prescribed timing by the resist rollers 5. The color image formed on the intermediate transfer belt 6 is secondary transferred onto the transfer paper forming a color image on the transfer paper. The transfer paper on which this color image has been formed is discharged to a discharge paper tray 8 which constitutes a discharge paper unit following the fixing of a toner image by a fixing unit 7 serving as fixing means.

Figure 2:
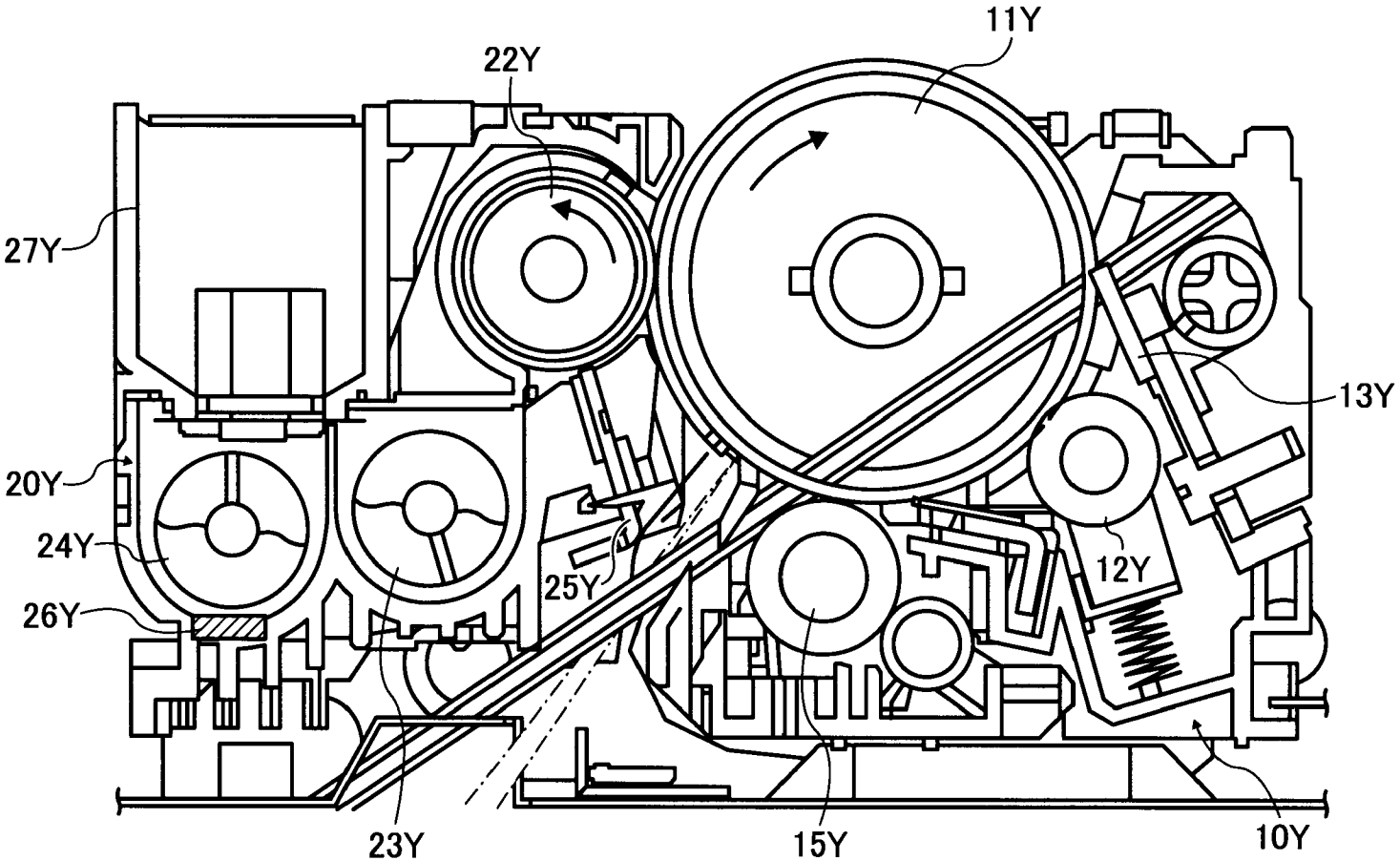
FIG. 2 is a schematic configuration diagram of a yellow imaging means of the imaging means of the laser printer.

FIG. 2 shows the schematic configuration of yellow imaging means 1Y of imaging means 1Y, 1C, 1M, 1BK. The remaining imaging means 1M, 1C, 1BK have an identical configuration thereto and, accordingly, the description thereof has been omitted.

Imaging means 1Y in the diagram comprises, as described above, a photoreceptor unit 10Y and a development apparatus 20Y. The photoreceptor unit 10Y comprises, for example, in addition to the photoreceptor 11Y, a cleaning blade 13Y for cleaning the photoreceptor surface and a charge roller 15Y serving as charge means for uniformly charging the photoreceptor surface. It further comprises a lubricant coating decharging brush roller 12Y with the dual function of coating a lubricant to the photoreceptor surface and decharging the photoreceptor surface. The brush part of the lubricant-coating decharging brush roller 12Y is configured from electroconductive fibers, and a decharging power source not shown in the diagram for imparting a decharging bias is connected to a core metal part thereof.

The surface of the photoreceptor 11Y of the photoreceptor unit 10Y of the configuration described above is uniformly charged by the charge roller 15Y to which a voltage has been imparted. When a laser light $L_Y$ modulated and polarized by the optical writer unit not shown in the diagram is scanned and irradiated on the surface of the photoreceptor 11Y, an electrostatic latent image is formed on the surface of the photoreceptor 11Y. The electrostatic latent image on the photoreceptor 11Y is developed by a later-described development apparatus 20Y resulting in the formation of a yellow toner image. Using a primary transfer unit in which the photoreceptor 11Y and intermediate transfer belt 6 are opposing, the toner image on the photoreceptor 11Y is transferred onto the intermediate transfer belt 6. The surface of the photoreceptor 11Y following the transfer of the toner image therefrom is cleaned by the cleaning blade 13Y serving as photoreceptor cleaning means, and is then coated with a prescribed amount of lubricant by the lubricant-coating decharging brush roller 12Y and decharged by way of preparation for forming the next electrostatic latent image.

The development apparatus 20Y uses a two-component developer containing a magnetic carrier and a negatively charged toner (hereinafter simply referred to as "developer") serving as a developer for developing the abovementioned electrostatic latent image. The development apparatus 20Y additionally comprises, for example, a development sleeve 22Y configured from a non-magnetic material serving as a developer carrier which is disposed so as to be partially exposed from an opening of the photoreceptor side of a development case, a magnetic roller (not shown in the diagram) as magnetic field generating means which is fixedly-arranged in the interior of the development sleeve 22Y, agitating carry screws 23Y, 24Y that serve as agitating carry members, development doctor 25Y, magnetic permeability sensor 26Y serving as toner density detection means, and a powder pump 27Y serving as a toner supply apparatus. A development bias voltage comprising an alternating-current voltage AC (alternating component) overlaid on a negative direct-current voltage DC (direct current component) by a development bias power source not shown in the diagram which serves as development magnetic field forming means is imparted to the development sleeve 22Y, whereupon the development sleeve 22Y is biased to a prescribed voltage with respect to a metal base layer of the photoreceptor 11Y. The development bias voltage may be established to impart a negative direct current voltage DC (direct current component) only.

As a result of the agitated carry by the agitated carry screws 23Y, 24Y of the developer housed in the development case of FIG. 2, the toner is frictionally charged. Some of the developer of a first agitation carry path in which the first agitated carry screw 23Y is arranged is carried on the surface of the development sleeve 22Y and, after adjustment of the layer thickness thereof by the development doctor 25Y, is carried to a development region opposing the photoreceptor 11Y. In the development region, the toner of the developer on the development sleeve 22Y is adhered by a development magnetic field to the electrostatic latent image on the photoreceptor 11Y and a toner image is formed. Following this, the developer that has passed through the development region separates from the development sleeve 22Y at a developer separation electrode position on the development sleeve 22Y and is returned to the first agitation carry path. The developer carried along the first agitation carry path to the downstream end thereof is moved to the upstream end of the second agitation carry path in which the second agitation carry screw 24Y is arranged, and toner is supplied to the second agitation carry path. Following this, the developer carried along the second agitation carry path to the downstream end thereof is moved to the upstream end of the first agitation carry path. The magnetic permeability sensor 26Y is arranged in the development case section from which the base part of the second agitation carry path is configured.

The toner density of the developer in the development case drops accompanying image formation in accordance with toner usage and, accordingly, based on an output value Vt of the magnetic permeability sensor 26Y, it is controlled to the appropriate range by toner supplied in accordance with need by the powder pump 27Y from the toner cartridge 30Y shown in FIG. 2. The toner supply control is performed on the basis of a difference value Tn ($=Vt_{ref}-V_t$) between a target output value $Vt_{ref}$ which constitutes a toner density control standard value and an output value Vt so that when this difference value Tn is + (plus) and the toner density is judged to be sufficiently high there is no toner supplied, and so that when this difference value Tn is − (minus) the toner supply amount is increased by the amount that the absolute value of the difference value Tn has been increased so that the output value Vt approximates the value of the target output value $Vt_{ref}$.

In addition, the target output value $Vt_{ref}$, charge electric potential and light quantity and so on are adjusted by a process control at a frequency of once every image formation copy number of 10 (for approximately 5 to 200 copies depending on copy speed and so on). More particularly, for example, the density of the plurality of half-tones and solid patterns formed on the photoreceptor 11Y is detected by a reflection density sensor 62 serving as image density detection means shown in FIG. 1, whereupon the amount of adhered toner is ascertained from the detected value thereof and the target output value $Vt_{ref}$, charge electric potential and quantity of light and so on are adjusted to ensure the amount of adhered toner reaches the target adhered amount.

Furthermore in the present embodiment, separately to the process control, a target output value correction processing for correcting the target output value $Vt_{ref}$ is executed for each individual image forming operation (print job). The specific details of this target output value correction processing will be described later in conjunction with a description of the particulars of the toner density control.

In addition, of the four photoreceptors 11Y, 11C, 11M, 11BK, only the photoreceptor 11BK for the color black located at the most downstream side is provided in a constant transfer nip contact state in which it is constantly in contact with the intermediate transfer belt 6, the remaining photoreceptors 11M, 11C, 11Y being provided in an isolated state with respect to the intermediate transfer belt. When a color image is being formed on transfer paper each of the four photoreceptors 11Y, 11C, 11M, 11BK abut the intermediate transfer belt 6. On the other hand, when a monochromatic image of black only is being formed on transfer paper, the photoreceptors 11Y, 11C, 11M for each of the other colors are isolated from the intermediate transfer belt 6 and only the photoreceptor 11BK for the color black in which a toner image is formed using black toner is caused to abut the intermediate transfer belt 6.

A control unit serving as control means for performing the toner density control will be hereinafter described.

Figure 3:
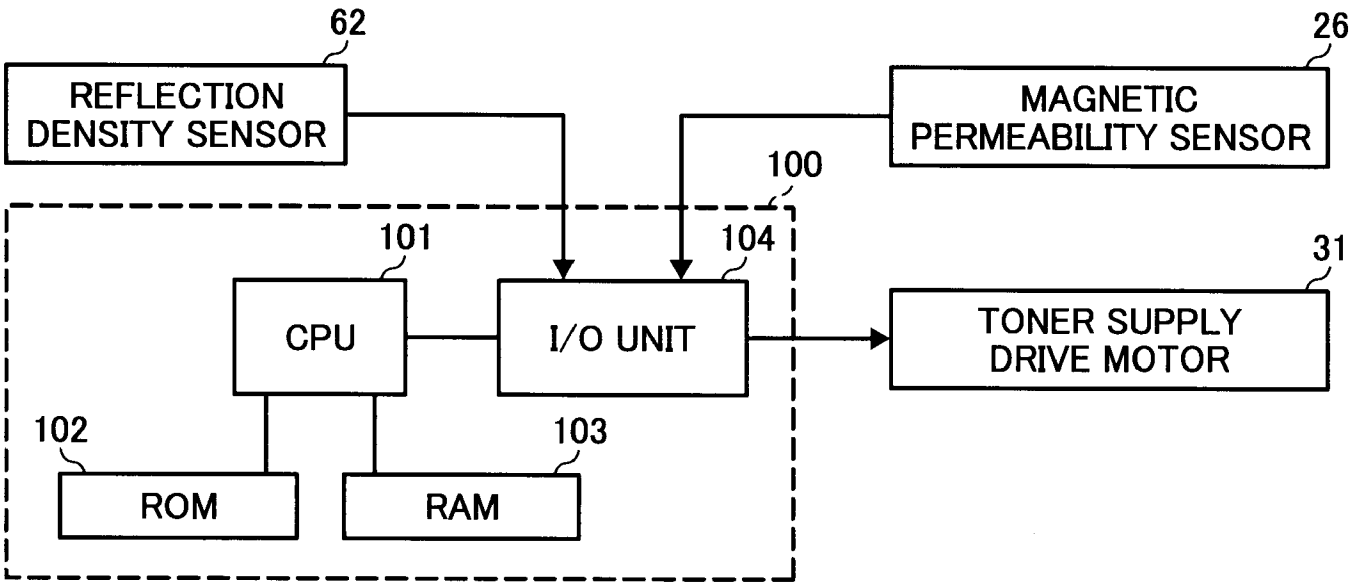
FIG. 3 is a diagram of the configuration of a control unit for performing toner density control in the laser printer.

FIG. 3 shows the configuration of a control unit for performing the toner density control.

A control unit 100 is provided in each development apparatus and, because the fundamental configuration of each is identical, the color differentiating symbols (Y, C, M, BK) have been omitted from the following description. Some component parts (CPU 101, ROM 102, RAM 103 and so on) of the control unit 100 of the development apparatus are shared by the development apparatuses.

The control unit 100 of the present embodiment is configured from, for example, a CPU 101, ROM 102, RAM 103, I/O unit 104. The magnetic permeability sensor 26 and intermediate transfer belt 62 are respectively connected to the I/O unit 104 by way of A/D converters not shown in the diagram. The control unit 100, as a result of the CPU 101 executing a prescribed toner density control program, performs a toner supply operation in which a control signal is transmitted by way of the I/O unit 104 to a toner supply drive motor 31 for driving a power pump 27. By the additional executing thereby of a prescribed target output value correction program, the target output value $Vt_{ref}$ for each individual image formation operation (print job) is corrected to ensure a constant image density is always produced. The toner density control program and target output value correction program and so on executed by the CPU are stored in the ROM 102. The RAM 103 comprises, for example, a Vt resistor for temporarily housing the output value Vt of the magnetic permeability sensor 26 acquired by way of the I/O unit 104, a $Vt_{ref}$ resistor for storing a standard output value $Vt_{ref}$ output by the magnetic permeability sensor 26 when the toner density of the developer in the development apparatus 20 is equivalent to the target toner density, and a Vs resistor for storing an output value Vs from the intermediate transfer belt 62.

Figure 4:
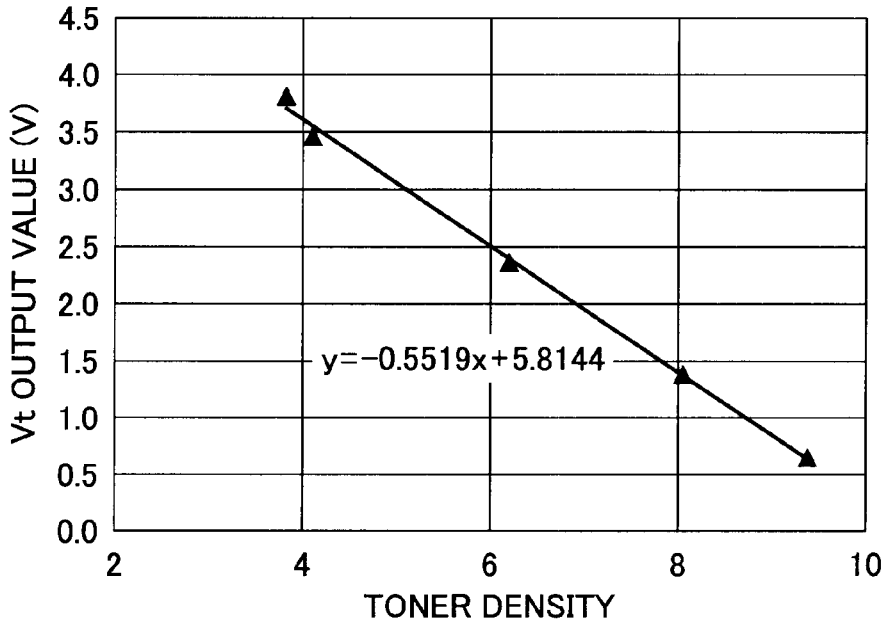
FIG. 4 is a graph in which the vertical axis denotes the output value of a magnetic permeability sensor and the horizontal axis denotes toner density of a developer for detection.

FIG. 4 is a graph in which the vertical axis denotes the output value of the magnetic permeability sensor 26 and the horizontal axis denotes the toner density of the developer serving as the detection subject. As shown in the graph, in the range of the actually used toner density the relationship between the output value of the magnetic permeability sensor 26 and the toner density of the developer approximates a straight line. In addition, the graph illustrates a characteristic whereby the higher the toner density of the developer the lower the output value of the magnetic permeability sensor 26. Utilizing this characteristic, the powder pump 27 is driven to supply toner when the output value Vt of the magnetic permeability sensor 26 is larger than the target output value $Vt_{ref}$. The toner supply control of the present embodiment is performed in accordance with the output value Vt of the magnetic permeability sensor 26 for each individual image formation operation (print job).

The target output value correction processing which constitutes a characterizing portion of the present embodiment will be hereinafter described.

Figure 5:
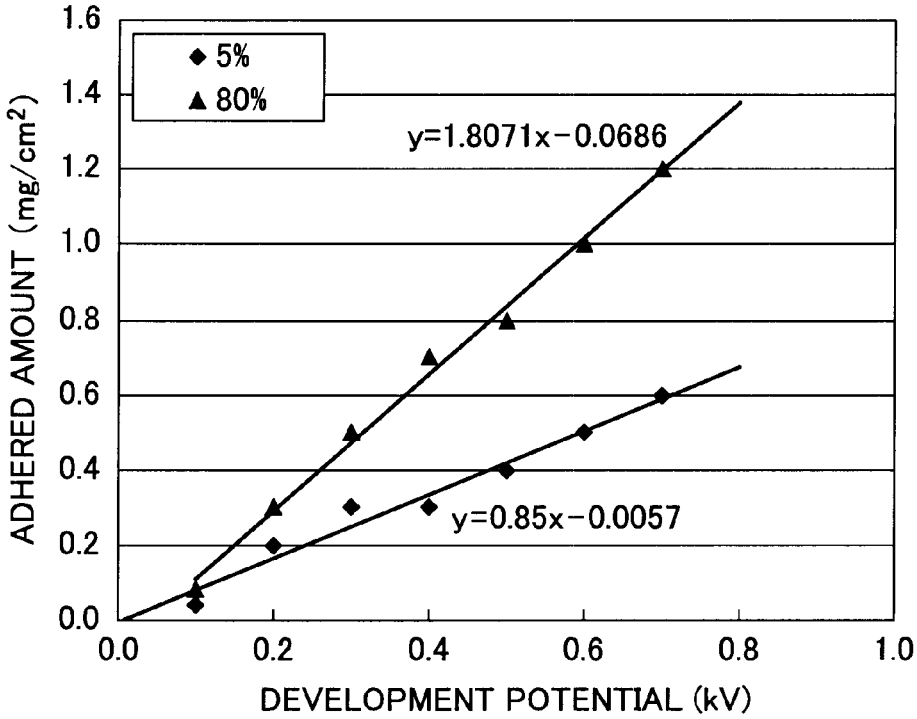
FIG. 5 is a graph showing differences in development γ in accordance with output image coverage ratio.

FIG. 5 is a graph that shows the difference in development γ according to the output image coverage ratio (gradient of the relational expression of toner affixing amount to development potential). The graph indicates values obtained when 100 copies of an identical image coverage ratio image have been continuously output at a standard line speed mode (138 [mm/sec]). As is clear from this graph, the development γ is higher in output images of high image coverage ratio. This is thought to be for the following reasons. That is to say, because of the large amount of toner replacement in the development apparatus 20 in a fixed time period when an image of high image coverage ratio is output, only a small amount of toner is present for a comparatively long time in the development apparatus 20. Accordingly, only a small amount of toner is thought to be excessively charged and, as a result, a higher development capability than possible when an image of low image coverage ratio in which there is a large amount of toner present in the development apparatus 20 for a comparatively long time (excessively charged toner) is output can be exhibited.

Differences in development capability arise during subsequent image formation as a result of the differences in toner replacement amount of the development apparatus 20 that occur in a fixed time period in this way. When differences in development capability occur differences in the image density of the formed images also occur and, accordingly, image formation at a constant image density cannot be performed. Thereupon, even if the toner replacement amount of the development apparatus 20 differs in a fixed time period, the target output value $Vt_{ref}$ is corrected to maintain a constant development capability. Fundamentally, the target output value $Vt_{ref}$ is corrected to ensure the development γ is constant. The toner density is adjusted so that, if the target output value $Vt_{ref}$ is corrected, the output value Vt of the magnetic permeability sensor 26 approximates the target output value $Vt_{ref}$ of the subsequent correction. As a result, the toner density is increased to raise the development capability when the toner replacement amount of the development apparatus 20 is large as is the case when an image of high image coverage ratio is output, or the toner density is decreased to lower the development capability when the toner replacement amount of the development apparatus 20 is small as is the case when an image of low image coverage ratio is output and, in this way, the development capability is made constant.

Moreover, the toner replacement amount of the development apparatus 20 for a fixed time period can be ascertained from various information such as the output image coverage [$cm^2$] and image coverage ratio [%]. The present embodiment describes the ascertaining toner of replacement amount on the basis of image coverage ratio that is the most easily understandable example means thereof. As described hereinafter, the utilization of the image coverage ratio [%] is based on conversion to a unit of toner replacement amount [mg/page]. When a 100% solid image is output onto an A4 transfer paper in the present embodiment when an appropriate development capability is being exhibited, 300 [mg] of toner will be consumed and 300 [mg] of replacement toner will be supplied. Accordingly, in this case, the toner replacement amount is 300 [mg/page]. However, when the image coverage ratio is converted to a toner replacement amount when, for example, the standard transfer paper is set as an A4 long-edge feed paper, the conversion and so on of the image coverage ratio must be based all the output transfer paper being converted to standard transfer paper. The developer volume of the development apparatus 20 of the present embodiment is 240 [g].

Figure 6:
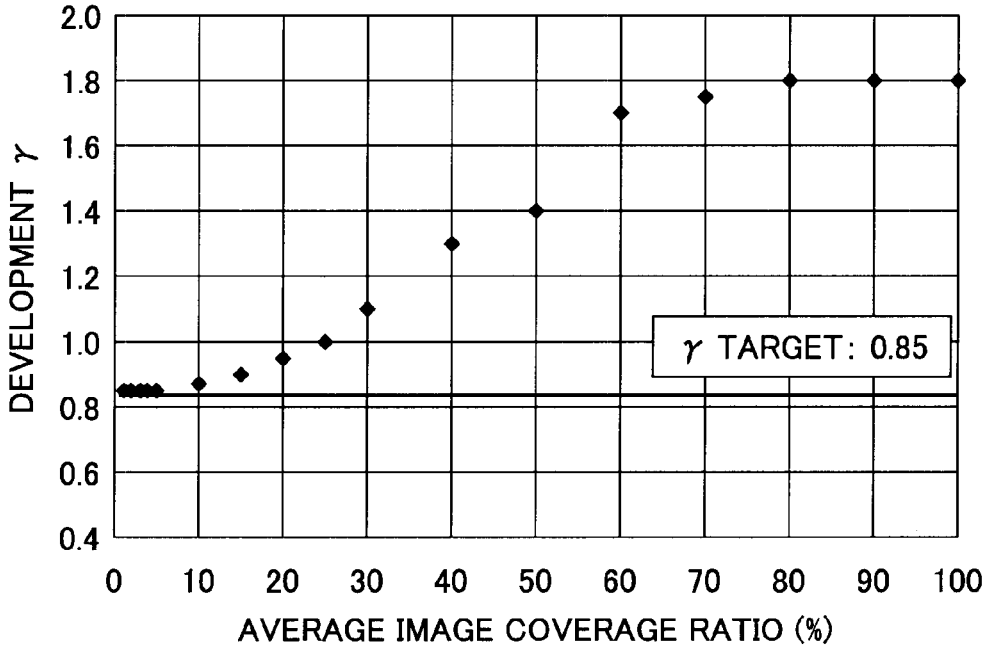
FIG. 6 is a graph in which the horizontal axis denotes the image coverage ratio and the vertical axis denotes development γ.

FIG. 6 is a graph that denotes image coverage ratio on the horizontal axis and development γ [(mg/cm$^2$)/kV] on the vertical axis. This graph, similarly to the graph shown in FIG. 5, describes values obtained following the continuous printing of 100 copies at each image coverage ratio at a constant toner density using a standard line speed mode. It is clear from this graph that the development γ tends to increase once the image coverage ratio exceeds 5[%]. Accordingly, the printer of the present embodiment desirably maintains a constant image density by raising the target output value $Vt_{ref}$ to induce a decrease in the toner density and a drop in the development γ when the image coverage ratio is higher than 5[%] Conversely, when an image coverage ratio not more than 5[%] is output after the target output value $Vt_{ref}$ has been increased, it must lower the target output value $Vt_{ref}$ to induce an increase in the toner density.

Figure 7:
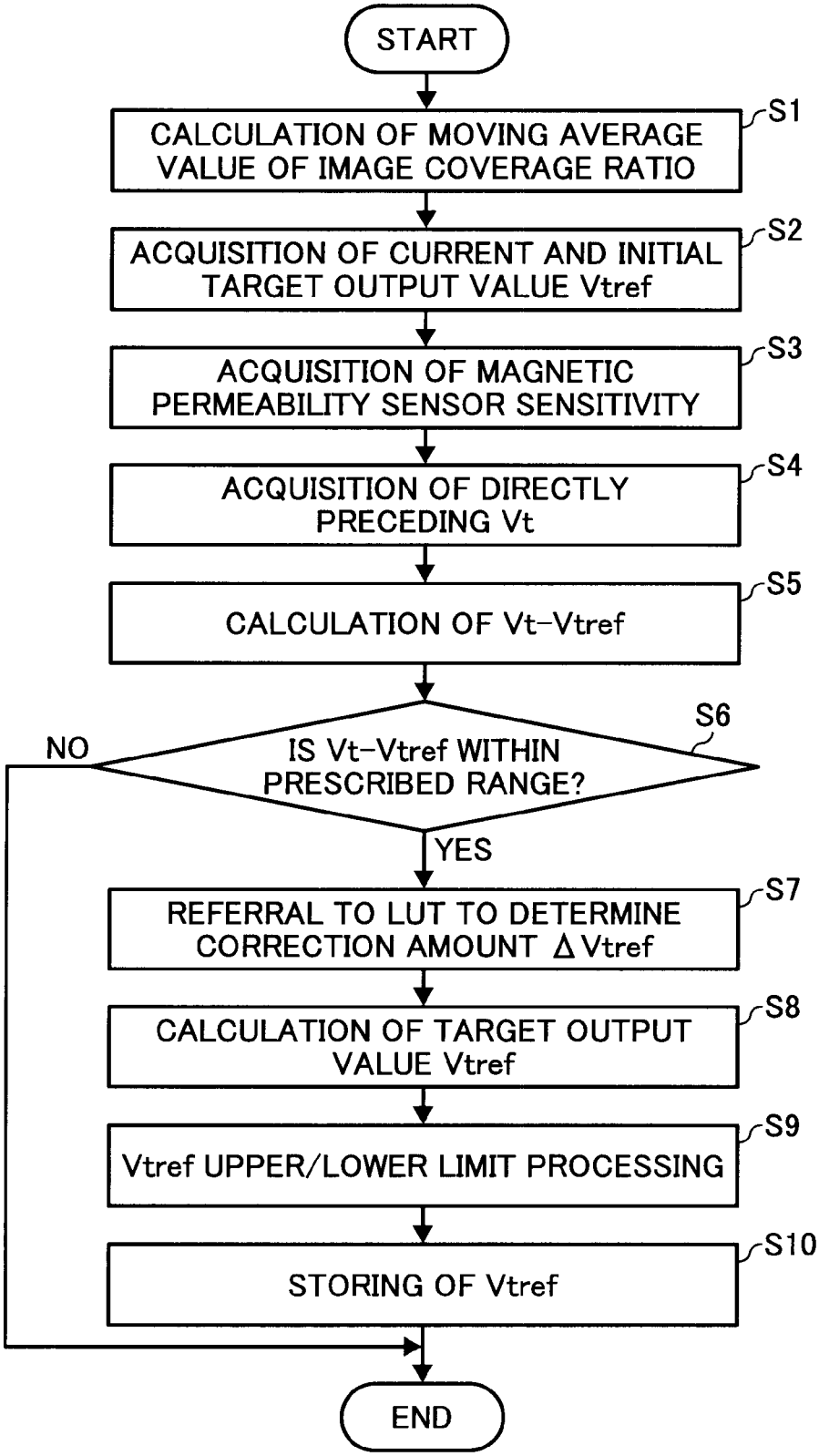
FIG. 7 is a flow chart showing the steps in the target output value correction processing of the laser printer.

FIG. 7 is a flow chart showing the steps in the target output value correction processing of the present embodiment.

The target output value correction processing is executed at the completion of each print JOB. When a print JOB is completed, the control unit 100 firstly calculates the moving average value of the image coverage ratio [%] of images output in a fixed time period of a directly preceding previous several copies or several tens of copies (S1). While in addition to a moving average value of image coverage ratio [%] simply the average value thereof may be used, the history of the toner replacement amount for a previous several tens of copies, which is suitable for understanding current developer characteristics, can be ascertained by employing the moving average value. Accordingly, the moving average value is employed in the present embodiment. For reasons of simplicity, an average value calculated in accordance with the expression (1) indicated below is employed.

$$M(i)=(1/N)(M(i-1)\times(N-1)+X(i)) \qquad \text{Expression (1)}$$

Here, "N" denotes the image coverage ratio sampling number (number of cumulative sheets), "M(i−1)" denotes the previously calculated moving average value, and "X(i)" denotes the current image coverage ratio. M(i) and X(i) are individually calculated for each color.

As in the present embodiment, because the current moving average value is determined employing a previously calculated moving average value, the need for the image coverage ratio data for several sheets or several tens of sheets to be stored in the RAM 103 is eliminated and, as a result, the usage region of the RAM 103 can be markedly reduced. In addition, control response can be altered by altering as appropriate the number of cumulative sheets N that serve as the target for calculation of the average value. For example, control can be more effectively performed by changing the number of sheets of transfer paper N over time or in accordance with environmental fluctuations.

When the moving average value of the image coverage ratio is calculated as described above, the control unit 100 then acquires from the $Vt_{ref}$ resistor the current target output value $Vt_{ref}$ and the initial target output value $Vt_{ref}$ (S2). In addition, the control unit 100 acquires sensitivity information of the magnetic permeability sensor 26 (S3). The sensitivity of the magnetic permeability sensor 26 is expressed using the unit [V/(wt %)] and is a value peculiar to the sensor (the absolute value of the gradient of the straight line plotted in FIG. 5 denotes sensitivity). In addition, the control unit acquires the directly preceding output value Vt of the magnetic permeability sensor 26 (S4) and, using the current target output value $Vt_{ref}$ acquired from S2, calculates $Vt-Vt_{ref}$ (S5). Following this, the control unit 100 judges whether or not the target output value $Vt_{ref}$ is to be corrected. For example, as judgment criteria it uses whether or not the processing control such as the preceding electric potential control has been successful or not or whether or not the result of the $Vt-Vt_{ref}$ calculated in S5 is within a prescribed range or not. In the present embodiment a judgment to whether or not the result of the $Vt-Vt_{ref}$ calculated by S5 is within a prescribed range or not is made (S6).

When the result of the $Vt-Vt_{ref}$ is within the prescribed range a correction amount $\Delta Vt_{ref}$ is determined by reference to an LUT (look-up) reference table (S7). More specifically, the LUT is initially referred to, and a toner density correction amount ΔTC (amount by which the toner density is altered) correspondent to the moving average value calculated by S1 is determined. After the toner density correction amount ΔTC has been determined, the target output value correction amount $\Delta Vt_{ref}$ is calculated from the below-noted expression (2) employing the sensitivity of the magnetic permeability sensor 26 acquired in S3. The calculated correction amount $\Delta Vt_{ref}$ is stored in the RAM 103. The correction amount $\Delta Vt_{ref}$ is individually calculated for each color.

$$\Delta Vt_{ref}=(-1)\times\Delta TC\times(\text{sensitivity of magnetic permeability sensor 26}) \qquad \text{Expression (2)}$$

FIG. 8 shows an example of an LUT 26 in which the sensitivity of the magnetic permeability sensor is 0.3.

The LUT used in the present embodiment is produced employing the following method.

Figure 9:
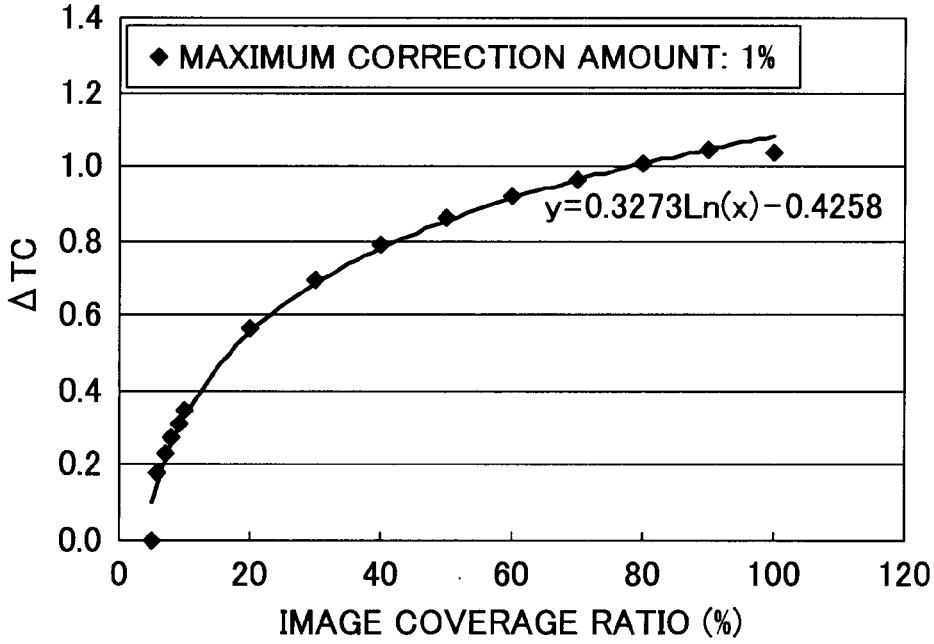
FIG. 9 is a graph in which the horizontal axis denotes a moving average value of the image coverage ratio and the vertical axis denotes a quantity by which the toner density is changed with respect to a standard toner density to ensure the development γ is made constant.

FIG. 9 is a graph in which the horizontal axis denotes the moving average value of the image coverage ratio [%] and the vertical axis denotes the minus direction toner density correction amount for altering the toner density with respect to a standard toner density to ensure a constant development γ is maintained [wt %]. It is clear from this graph that, for example, a constant development γ is maintained when the moving average value of the image coverage ratio is 80% and a toner density control is performed using a toner density correction amount ΔTC of −1 [wt %]. The toner density correction amount ΔTC with respect to the moving average value of the image coverage ratio can be approximated most precisely by logarithm approximation. For this reason, the toner density correction amount ΔTC with respect to the average moving value employed in the LUT is determined employing the method of logarithmic approximation. In the present embodiment, as shown in FIG. 8, the correction step is implemented in 1% increments when the moving average value is less than 10%, and the correction step is implemented in 10% increments when the moving average value is 10% or greater. The correction step is able to be altered as required in accordance with the characteristics of the developer and the development apparatus.

In addition, because the usage conditions of the developer are different for each color, various conditions, including the correction step and the execution timing of the target output value correction processing, can be made different for each development apparatus 20. It is particularly desirable that the maximum correction amount be adjusted for each color. In this case, replacing expression (2) above, expression (3) indicated below is employed.

$$\Delta Vt_{ref} = (-1) \times \Delta TC \times \text{(sensitivity of magnetic permeability sensor 26)} \times \text{(color correction coefficient)} \quad \text{Expression (3)}$$

Once the correction amount $\Delta Vt_{ref}$ has been determined with reference to the LUT as described above (S7), the control unit 100 then calculates for each color a post-correction target output value $Vt_{ref}$ from the determined correction amount $\Delta Vt_{ref}$ and the initial value of the $Vt_{ref}$ acquired from S2 based on the expression (4) indicated below (S8).

$$\text{(Post-corrected } Vt_{ref}\text{)=(initial value of } Vt_{ref}\text{)}+\Delta Vt_{ref} \quad \text{Expression (4)}$$

Next, the control unit 100 executes an upper/lower limit processing of the calculated $Vt_{ref}$ (S9). More specifically, when the calculated $Vt_{ref}$ exceeds the upper limit value determined in advance, the upper limit value is taken to be the post-corrected $Vt_{ref}$. On the other hand, when the calculated $Vt_{ref}$ falls short of the lower limit value determined in advance, this lower limit value is taken to be the post-corrected $Vt_{ref}$. Moreover, when the calculated $Vt_{ref}$ is between this upper limit value and the lower limit value, this calculated $Vt_{ref}$ is taken as the post-corrected $Vt_{ref}$. The post-corrected $Vt_{ref}$ obtained in this way is stored in the RAM 103 as the current $Vt_{ref}$ value (S10).

It is desirable that the target output value correction processing be executed during continuous printing between when a previous development is completed and when a subsequent development is to be initiated. Executing the processing at this timing in this way, the toner density control can be performed employing an appropriately corrected target output value $Vt_{ref}$ for each individual output image even during continuous printing.

A comparative test example involving a comparison of a case when the target output value correction processing described above has been performed and when it has not been performed will be hereinafter described.

Figure 10:
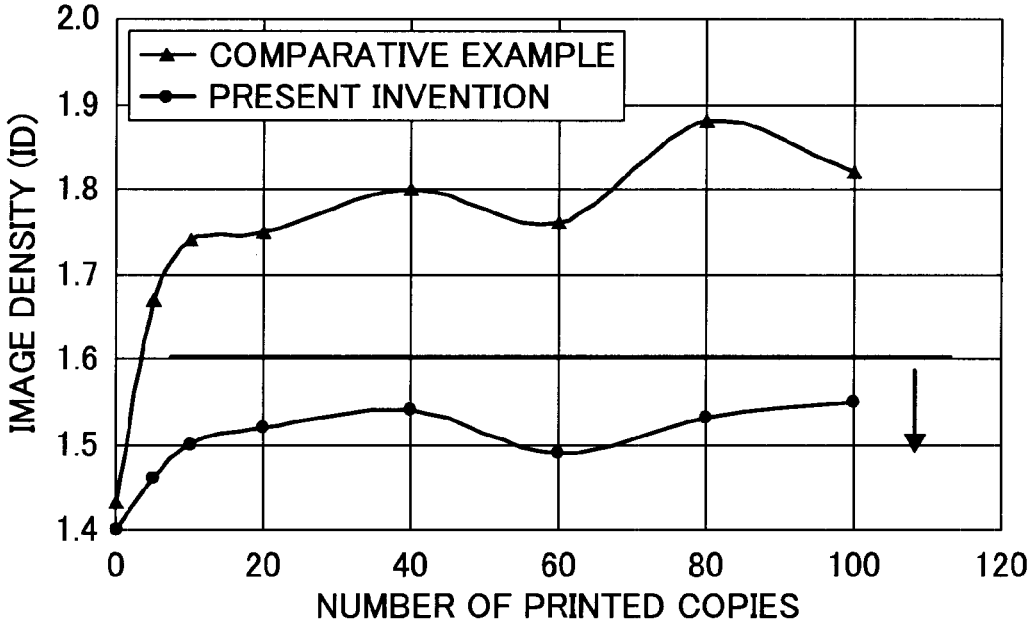
FIG. 10 is a graph showing the effects of a comparative test example.

FIG. 10 is a graph showing the results of this comparative test example. The laser printer of the embodiment described above was employed in this comparative test example, image density being measured when 100 copies of a solid image of image coverage ratio of 80% at standard line speed mode (138 [mm/sec]) were continuously formed. In the comparative example plotted on the graph as triangles there was no target output value correction processing employed and, therefore, an increase in image density occurred accompanying an increase in the number of continuous printed copies. In contrast, in the present embodiment plotted on the graph as circles the target output value correction processing was employed and, therefore, even as the number of continuous printed copies increased the image density was maintained within a substantially constant range. It was confirmed as a result that, even when an image of high image coverage ratio in which there is a large toner replacement amount is output, a stabilized constant image density can be produced by executing the target output value correction processing of the present embodiment.

The laser printer serving as the image forming apparatus pertaining to the present embodiment comprises a photoreceptor 11 as a latent image carrier, a development apparatus 20 that carries a two-component developer containing a toner and a magnetic carrier on a development sleeve 22 serving as a developer carrier and which performs development in which, as a result of the developer on the development sleeve 22 being brought into contact with the surface of the photoreceptor 11, toner is adhered to the latent image on the surface of the photoreceptor 11, a powder pump 27Y serving as a toner supply apparatus for supplying toner to the development apparatus 20, magnetic permeability sensor 26 as toner density detection means for detecting and outputting the toner density of the two-component developer in the development apparatus 20, and a control unit 100 serving as toner density control means for comparing an output value Vt of the magnetic permeability sensor 26 and a target output value $Vt_{ref}$ which constitutes a toner density control standard value and which, by controlling the power pump 27 on the basis of the detected result thereof, ensures that the output value Vt approximates the target output value $Vt_{ref}$. Also, in the laser printer, the control unit 100 functions as information detection means for detecting image coverage ratio which constitutes information for ascertaining the toner replacement amount of the development apparatus 20 in a prescribed time period from when a previous process control was performed. In addition, the control unit 100 functions as correction means and, on the basis of the detected result of image coverage ratio, corrects the target output value $Vt_{ref}$ so that a constant development capability of the development apparatus 20 is maintained. By virtue of this, even when image forming that involves a significant change in the toner replacement amount in the development apparatus 20 as a result of this correction is performed, for example, even when an image of high image coverage ratio is output, the toner density is adjusted to maintain the development capability at a constant, and a constant image density is ensured. Moreover, using this laser printer, because information for ascertaining the toner replacement amount of the development apparatus 20 (image coverage ratio) can be detected without consuming toner, toner does not need to be used to correct the target output value $Vt_{ref}$.

More particularly, because the information detection means of the present embodiment constitutes the control unit 100 which functions as image coverage ratio detection means for detecting image coverage ratio of images formed in a prescribed time period, information for ascertaining the toner replacement amount can be detected without consuming toner using a comparatively simple and easy configuration.

In addition, in the present embodiment, the control unit 100 corrects the target output value $Vt_{ref}$ on the basis of a moving average value of the image coverage ratio of images formed in a prescribed time period obtained from detected results of image coverage ratio. By virtue of this, toner replacement amount history of several previous sheets that is suitable for ascertaining current developer characteristics can be ascertained. As a result, the target output value $Vt_{ref}$ can be more appropriately corrected. More particularly, because the value calculated on the basis of expression (1) noted is employed as the moving average value M(i), as is described above the usage region of the RAM 103 can be markedly reduced.

In addition, the control unit 100 of the present embodiment serves as sampling number altering means for altering the sampling number N of the image coverage ratio when the moving average value M(i) is determined. By virtue of this, the response and significance of the control can be altered and, for example, the sampling number N can be altered as appropriate and effectively controlled over time and in accordance with environment fluctuations.

In addition, the present embodiment comprises RAM 103 or ROM 102 as storage means for storing the correction amount $\Delta Vt_{ref}$ correspondent to each plurality of moving average values M(i), and the control unit 100 reads out the correction amount $\Delta Vt_{ref}$ correspondent to each plurality of moving average values M(i) from the RAM 103 or ROM 102, and employing the read correction amount $\Delta Vt_{ref}$, corrects the target output value $Vt_{ref}$. By virtue of this, precise correction of the target output value $Vt_{ref}$ is possible and the precision of the control is improved. In addition, alteration of the correction step is comparatively easy.

The control unit 100 may correct the target output value $Vt_{ref}$ on the basis of, rather than a moving average value, an average value of the image coverage ratio of images formed in a prescribed time period obtained from the detected result of image coverage ratio. In this case, the image coverage ratio of the images formed in the prescribed ratio can be appropriately ascertained using a simple method.

In addition, in the present embodiment, the control unit 100 functions as maximum correction width altering means for correcting the maximum correction width of the correction amount $\Delta Vt_{ref}$. By virtue of this, the response and significance of the control can be altered and, for example, the sampling number N can be altered as appropriate and effectively controlled over time and in accordance with environment fluctuations.

In addition, the laser printer pertaining to the present embodiment comprises a plurality of development apparatuses 20Y, 20C, 20M, 20BK for each different color, a power pump 27 and magnetic permeability sensor 26 being provided in each development apparatus 20Y, 20C, 20M, 20BK, and the image formation being performed by transfer onto a transfer paper serving as a final recording medium of a superposed toner image formed by the superposing of color toner images obtained by development in the development apparatuses 20Y, 20C, 20M, 20BK. The control unit 100 alters the maximum correction width independently for each development apparatus 20. By virtue of this, correction appropriate to the usage conditions for the different developers for each color is possible.

In addition, on the basis of the detected result of image coverage ratio, the control unit 100 of the present embodiment corrects the target output value $Vt_{ref}$ when the toner replacement amount is greater than a standard amount in the development apparatus 20 in a prescribed time period so that the toner density decreases, and corrects the target output value $Vt_{ref}$ when the toner replacement amount is equal to or less than a standard amount in the development apparatus 20 in a prescribed time period so that the toner density decreases. By virtue of this, in a configuration such as of this embodiment in which, when an image of, for example, a high image coverage ratio is output, the development potential increases and development $\gamma$ increases, the target output value $Vt_{ref}$ can be corrected easily and appropriately.

In addition, the control unit 100 of the present embodiment corrects the target output value $Vt_{ref}$ between when the development by the developer apparatus 20 is finished and the next development is started. By virtue of this, the toner density control can be performed for each output image sheet employing an appropriately corrected target output value $Vt_{ref}$.

As is described above, in the present embodiment, information for ascertaining the toner replacement amount in a development apparatus is detected in a prescribed time period. How much toner is used in the development apparatus in a prescribed time period and how much new toner is supplied thereto can be ascertained from this information. That is to say, the percentage of new toner and the percentage of old toner present in the development apparatus can be ascertained. Because, by virtue of this, the development capability can be ascertained, a toner density control standard value can be corrected on the basis of this information to ensure a constant development potential of the development apparatus is maintained. As a result, even if image formation in which changes in the toner replacement amount in the development apparatus occur is performed, the development capability can be maintained at a constant by adjustment of the toner density and a constant image density can be produced. Because the information for ascertaining the toner replacement amount in the development can be detected without consuming toner, toner need not be used for correcting the toner density control standard value in the present invention.

As described above, the present invention affords the excellent effect whereby a constant image density is able to be obtained by correcting a toner density control target value without consuming toner.

Various modifications will become possible for those skilled in the art after receiving the teachings of the present disclosure without departing from the scope thereof.

What is claimed is:

1. An image forming apparatus, comprising:

a latent image carrier;

a development apparatus in which a two-component developer containing a toner and a magnetic carrier is carried on a developer carrier and which performs development in which, by bringing the two-component developer on the developer carrier into contact with the surface of the latent image carrier, the toner is adhered to the latent image on the surface of the latent image carrier;

a toner supply apparatus configured to supply the toner to the development apparatus;

toner density detection means for detecting and outputting toner density of the two-component developer in the development apparatus;

toner density control means for comparing an output value of the toner density detection means and toner density control standard value and, by controlling the toner supply apparatus on the basis of the comparative result, controlling the toner density so that the output value approximates the toner density control standard value;

information detection means for detecting information for ascertaining a toner replacement amount in the development apparatus in a prescribed time period, the information including an image coverage ratio of the latent image; and correction means for correcting the toner density control standard value to produce a corrected toner density control standard value on the basis of the detected result by the information detection means during continuous printing between when a previous development is completed and when a subsequent development is to be initiated so as to maintain a predetermined development capability of the development apparatus.

2. The image forming apparatus as claimed in claim 1, wherein the information detection means constitutes image coverage ratio detection means for detecting the image coverage ratio of an image formed in the prescribed time period.

3. The image forming apparatus as claimed in claim 2, wherein the correction means corrects the toner density control standard value in accordance with an average value of an image coverage ratio of an image formed in the prescribed time period obtained from the detected result by the image coverage ratio detection means.

4. The image forming apparatus as claimed in claim 2, wherein the correction means corrects the toner density control standard value in accordance with a moving average value of an image coverage ratio of an image formed in the prescribed time period obtained from the detected result by the image coverage ratio detection means.

5. The image forming apparatus as claimed in claim 2, wherein the moving average value M(i) is calculated on the basis of the following numerical expression:

$$M(i)=(1/N)\times\{M(i-1)\times(N-1)+X(i)\},$$

where "N" denotes the sampling number of the image coverage ratio, "M(i−1)" denotes the previously calculated moving average value, and "X(i)" denotes the detected image coverage ratio.

6. The image forming apparatus as claimed in claim 4, further comprising sampling number altering means for altering the sampling number of the image coverage ratio when the moving average value is determined.

7. The image forming apparatus as claimed in claim 4, further comprising storage means for storing correction values correspondent to each of the plurality of moving average values, wherein the correction means reads from the storage means a correction value correspondent to a moving average value of an image coverage ratio of an image formed in the prescribed time period obtained from the detected result by the image coverage ratio detection means and, employs the correction value to correct the toner density control standard value.

8. The image forming apparatus as claimed in claim 1, further comprising means for altering a maximum correction amount based on the corrected toner density control standard value produced by the correction means.

9. The image forming apparatus as claimed in claim 8, comprising a plurality of the development apparatus for each different color, the toner supply apparatus and the toner density detection means being provided in each development apparatus, and image formation being performed by finally transferring to a recording material a superposed toner image formed by the superposing of toner images in each color obtained by development in the development apparatuses.

10. The image forming apparatus as claimed in claim 1, wherein the correction means, on the basis of the detected result of the information detection means, corrects the toner density control standard value so that when the toner replacement amount of the development apparatus in the prescribed time period is greater than a standard amount the toner density is decreased, and corrects the toner density control standard value so that when the toner replacement amount of the development apparatus in the prescribed time period is equal to or less than the standard value amount the toner density is increased.

11. The image forming apparatus as claimed in claim 1, wherein the information detection means includes at least a reflection density sensor.

12. An image forming apparatus, comprising:

a latent image carrier;

a development apparatus in which a two-component developer containing a toner and a magnetic carrier is carried on a developer carrier and which performs development in which, by bringing the two-component developer on the developer carrier into contact with the surface of the latent image carrier, the toner is adhered to the latent image on the surface of the latent image carrier;

a toner supply apparatus configured to supply the toner to the development apparatus;

a toner density detection unit that detects and outputs toner density of the two-component developer in the development apparatus;

a toner density control unit that compares an output value of the toner density detection means and toner density control standard value and, by controlling the toner supply apparatus on the basis of the comparative result, controls the toner density so that the output value approximates the toner density control standard value;

an information detection unit that detects information, during continuous printing, for ascertaining a toner replacement amount in the development apparatus in a prescribed time period, the information including an image coverage ratio of the latent image; and a correction unit that corrects the toner density control standard value to produce a corrected toner density control standard value on the basis of the detected result by the information detection unit during the continuous printing between when a previous development is completed and when a subsequent development is to be initiated so as to maintain a predetermined development capability of the development apparatus.

13. The image forming apparatus as claimed in claim 12, wherein the information detection unit includes at least a reflection density sensor.

14. The image forming apparatus as claimed in claim 12, wherein the toner density detection unit comprises a magnetic permeability sensor.

* * * * *